US005695330A

United States Patent [19]

Epworth

[11] Patent Number: 5,695,330

[45] Date of Patent: Dec. 9, 1997

[54] METHOD AND APPARATUS FOR CURING PAINT ON A SURFACE

[76] Inventor: Larry N. Epworth, R.R. #2, Woodbridge, Ontario, Canada, L4L 1A6

[21] Appl. No.: 348,937

[22] Filed: Nov. 25, 1994

[30] Foreign Application Priority Data

Nov. 25, 1993 [GB] United Kingdom ..... 9324260

[51] Int. Cl.[6] ..... F27B 9/00

[52] U.S. Cl. ..... 432/148; 432/121; 432/127; 432/146

[58] Field of Search ..... 432/121, 136, 432/137, 143, 146, 147, 148

[56] References Cited

U.S. PATENT DOCUMENTS

| | | | |
|---|---|---|---|
| 3,947,241 | 3/1976 | Caridis et al. | 432/121 |
| 4,012,190 | 3/1977 | Dicks et al. | 432/146 |
| 4,884,967 | 12/1989 | Meyer | 432/127 |
| 5,000,158 | 3/1991 | Watson et al. | 432/148 |

*Primary Examiner*—Henry A. Bennett
*Assistant Examiner*—Jiping Lu
*Attorney, Agent, or Firm*—Shoemaker and Mattare, Ltd.

[57] ABSTRACT

A means for curing heat-curable paint on vehicle panels includes an elongate pipe defining an internal combustion chamber with a fuel burner at one end of the pipe and means for removing combustion products from the other end of the pipe. The pipe is clamped in a substantially horizontal position and has "bellows" means allow for thermal contraction and expansion. Two part-cylindrical baffles are supported at opposite sides of the pipe but spaced therefrom and from each other so as to define an upper elongate opening. Ignition means are provided to ignite fuel within the burner, to initiate combustion whereby the outer surface of the pipe emits radiant heat primarily through the upper elongate opening, while convective heat is transferred to air passing upwardly between the baffles and the pipe.

16 Claims, 6 Drawing Sheets

METHOD AND APPARATUS FOR CURING PAINT ON A SURFACE

This invention relates to a method and apparatus by which paints that are currently applied to automobiles, particularly to the rocker panels of automobiles, can be successfully cured.

BACKGROUND OF THIS INVENTION

Because of ecological considerations, the automotive industry has recently shifted to the use of environment-friendly paints for car exteriors. These newly formulated paints must be subjected to relatively high temperatures over a certain duration of time in order to cure or "set" properly. Moreover, these new paints are quite sensitive to the timing and temperature levels applied.

Typically, the heat needed to cure the paint on the outside of a vehicle is applied in an elongated heat tunnel or furnace having track and carriage means by which automobiles can be transported down the center of the oven. Typically, natural gas is burned to provide the heat for the oven.

Because the rocker panels are located at the lowest point of the automobile body, and because heated air (or other gas) tends to rise, the rocker panel regions of the automobiles tend to be subjected to a lower degree of heat, or to be exposed to an appropriate level of heat for a shorter time than the paint on the rest of the automobile. If the temperature level is too low, or if the time of exposure to a proper level of temperature is too short, complete curing of the rocker panel paint will not take place, and as a result the paint will tend to chip, streak or break away during normal use of the automobile.

GENERAL DESCRIPTION OF THIS INVENTION

In view of the foregoing shortcomings of the conventional process, it is an object of one aspect of this invention to provide a method and apparatus for ensuring that the paint on the rocker panel of a car passing through the curing tunnel will be properly cured by reason of being subjected to sufficiently high temperatures for a sufficiently long time.

Specifically, this invention provides, in combination:

an elongate pipe defining an internal combustion chamber, clamping means for supporting the pipe in a substantially horizontal position, two part-cylindrical baffles, support means for supporting the baffles generally at opposite sides of the pipe so that they am generally concentric therewith, but are spaced from the pipe and from each other so as to define an upper elongate opening, a fuel burner at one end of the pipe, feed means for delivering fuel and air simultaneously to the fuel burner, and an ignition device for igniting fuel within the burner so that combustion takes place in said combustion chamber, whereby the outer surface of the pipe emits radiant heat primarily through said upper elongate opening, and convective heat is transferred to air passing upwardly between the baffles and the pipe.

Further, this invention provide apparatus for curing heat-curable paint on vehicle rocker panels, comprising:

transport means for moving vehicle rocker panels substantially horizontally at a controllable speed, an elongate pipe defining an internal combustion chamber, the pipe being clamped in a position in which it is below but adjacent to the path along which the rocker panels are moved by said transport means.

two part-cylindrical baffles, support means for supporting the baffles generally at opposite sides of the pipe so that they are generally concentric therewith, but are spaced from the pipe and from each other so as to define an upper elongate opening directed generally at the path along which the rocker panels are moved, a fuel burner at one end of the pipe, feed means for delivering fuel and air simultaneously to the fuel burner, and an ignition device for igniting fuel within the burner, so that combustion takes place in said combustion chamber, whereby the outer surface of the pipe emits radiant heat primarily through said upper elongate opening, the radiant heat intersecting said path, and whereby convective heat is transferred to air passing upwardly between the baffles and the pipe, at least a portion of the thus heated air impinging against rocker panels moving along said path.

Finally, this invention provides a method for curing heat-curable paint on external vehicle surfaces, comprising:

A. providing an apparatus including:

a) transport means for moving the surfaces substantially horizontally at a controllable speed with the surfaces substantially aligned with the direction of their movement, b) an elongate pipe defining an internal combustion chamber, the pipe being clamped in a position in which it is below but adjacent to the path along which the surfaces move, c) two part-cylindrical baffles supported generally at opposite sides of the pipe so that they are generally concentric therewith, but are spaced from the pipe and from each other so as to define an upper elongate opening directed generally at the path along which the surfaces are moved, and d) a fuel burner at one end of the pipe, B. delivering fuel and air simultaneously to the fuel burner, and igniting fuel within the burner so that combustion takes place in said combustion chamber, resulting in:

e) the outer surface of the pipe emitting radiant heat primarily through said upper elongate opening, the radiant heat intersecting said path, and f) convective heat being transferred to air passing upwardly between the baffles and the pipe, at least a portion of the thus heated air impinging against surfaces moving along said path.

GENERAL DESCRIPTION OF THE DRAWINGS

Two embodiments of this invention are illustrated in the accompanying drawings, in which like numerals denote like parts throughout the several views, and in which.

DETAILED DESCRIPTION OF THE DRAWINGS

Figure 1:
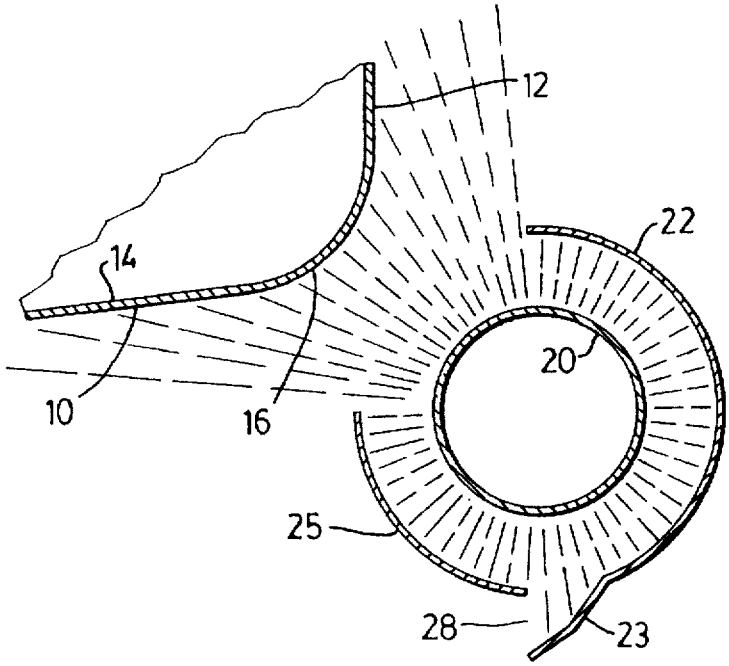
FIG. 1 is a vertical cross-sectional view taken perpendicular to the axis of the main heat-emitting portion of one embodiment of this invention.

Attention is first directed to FIG. 1, which shows a rocker panel 10 of an automobile, the rocker panel 10 including an upright region 12, a generally horizontal region 14, and a rounded shoulder portion 16.

It is to be understood that the rocker panel 10 in FIG. 1 is seen in section, and that the automobile of which it is a part is moving in the direction perpendicular the plane of the drawing sheet.

Extending longitudinally in the direction of movement of the automobile is an emitter pipe 20, which may be of stainless steel, aluminized steel, or any other material capable of withstanding relatively high temperatures, and of acting as an infrared transmitter when at high temperatures. The emitter pipe 20 also constitutes an elongate combustion chamber into which natural gas or the like is injected at one end, mixed with primary air, and burned to provide a long, luminous flame. Preferably, the combustion ratio within the emitter pipe 20 is set very close to stoichiometric, but includes a small amount of excess oxygen in order to avoid the generation of carbon monoxide. In a typical installation, the emitter pipe 20 would be provided as three or four lengths of pipe, the lengths of pipe being coupled together with "bellows type" joints in order to allow for thermal expansion.

Concentrically arranged around the emitter pipe 20 is a first part-cylindrical portion 22 extending from approximately the 12 o'clock position to about the 5 o'clock position, with a panel 23 extending downwardly and leftwardly from the lower termination of the part-cylindrical portion 22.

The first part-cylindrical portion 22 is constructed of a material capable of reflecting most of the infrared radiation impinging upon it. Typically, this portion may be of stainless steel or of aluminum-coated steel sheet.

Preferably, a second part-cylindrical portion 25 is also provided, the portions 22 and 25 being coaxial and having the same radius of curvature.

With the arrangement illustrated in FIG. 1, it will be appreciated that infrared radiation projected from the emitted pipe 20 will either impinge directly against the rocker panel (because it exits between the terminations of the first and second part-cylindrical portions 22 and 25), or will impinge upon the part-cylindrical portions 22 and 25, from where it will be reflected back again to the emitter pipe 20, thence bouncing back and forth until it eventually exits through the major opening at upper left of the emitter pipe 20, between the terminations of the part-cylindrical portions 22 and 25.

It will be noted that the bottom terminations of the first and second part-cylindrical portions 22 and 25 are separated to provide an opening 28, the opening 28 being partly covered by the panel 23. The opening 28 constitutes an entry port where relatively cooler air can enter the space between the emitter pipe 20 and the part-cylindrical portions 22 and 25. Any entering air is immediately heated, and thus will rise up around both sides of the emitter pipe 20 and flow out in the upward and leftward direction (as pictured in FIG. 1) where it will impinge against a substantial portion of the rocker panel 10.

By arranging for the heated air to move in an upward flow against the rocker panel 10, there is provided a kind of insulating air "buffer" which restricts convective loss of heat from the rocker panel because it envelops the rocker panel and has a temperature similar to that of the rocker panel.

Because proper curing of the paint on the rocker panel 10 requires the rocker panel to achieve a temperature within a narrow band, it will be understood that a) the heat output of the emitter pipe 20, b) the distance between the emitter pipe 20 and the rocker panel 10 and c) the extent of the convective air flow around the emitter pipe 20 and then upwardly and leftwardly toward the rocker panel, must be capable of fine adjustment. The amount of fuel burned in the emitter pipe 20 controls the essential heat output of the device, while an adjustment of the installed position ensures a desired spacing between the emitter pipe 20 and the rocker panel 10. The air flux through the device is of course dependent upon the size of the opening 28 and the component temperatures.

Figure 2:
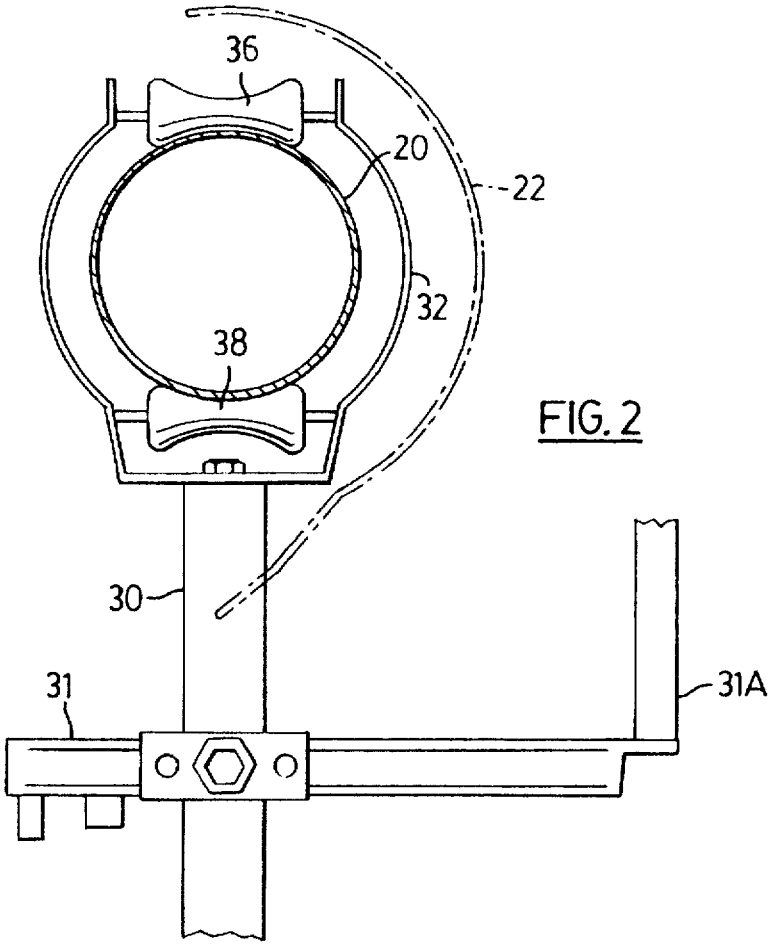
FIG. 2 is a vertical cross-sectional view of the support mechanism for the central heat-emitter of the first embodiment.

Attention is now directed to FIG. 2, which shows the emitter pipe 20 in sectional view, and the first part-cylindrical portion 22 in broken lines. A plurality of support and stabilizer posts 30 are positioned at intervals along the emitter pipe 20, each being adjustably secured to a horizontal brace 31 which is secured to the existing oven wall 31A at its rightward end and to the existing conveyor track (not shown) at its leftward end. Each post supports a roller frame 32 which supports two mandrels 36 and 38 for free rotation. It will be seen that each mandrel 36, 38 is radially symmetrical and has a concave waist portion adapted to achieve line contact with the exterior of the emitter pipe 20. The provision of the mandrels 36 and 38 fixes the horizontal and vertical positions of the emitter pipe 20 but allows the latter some freedom of movement in the axial direction (to accommodate thermal expansion).

In actual practice, it has been found that the second part-cylindrical portion 25 is not essential to the proper working of the device.

In a typical installation, the external wall of the emitter pipe reaches temperatures in excess of 1200° F.

Attention is now directed to FIGS. 3–8, for a description of the second embodiment of this invention.

Figure 3:
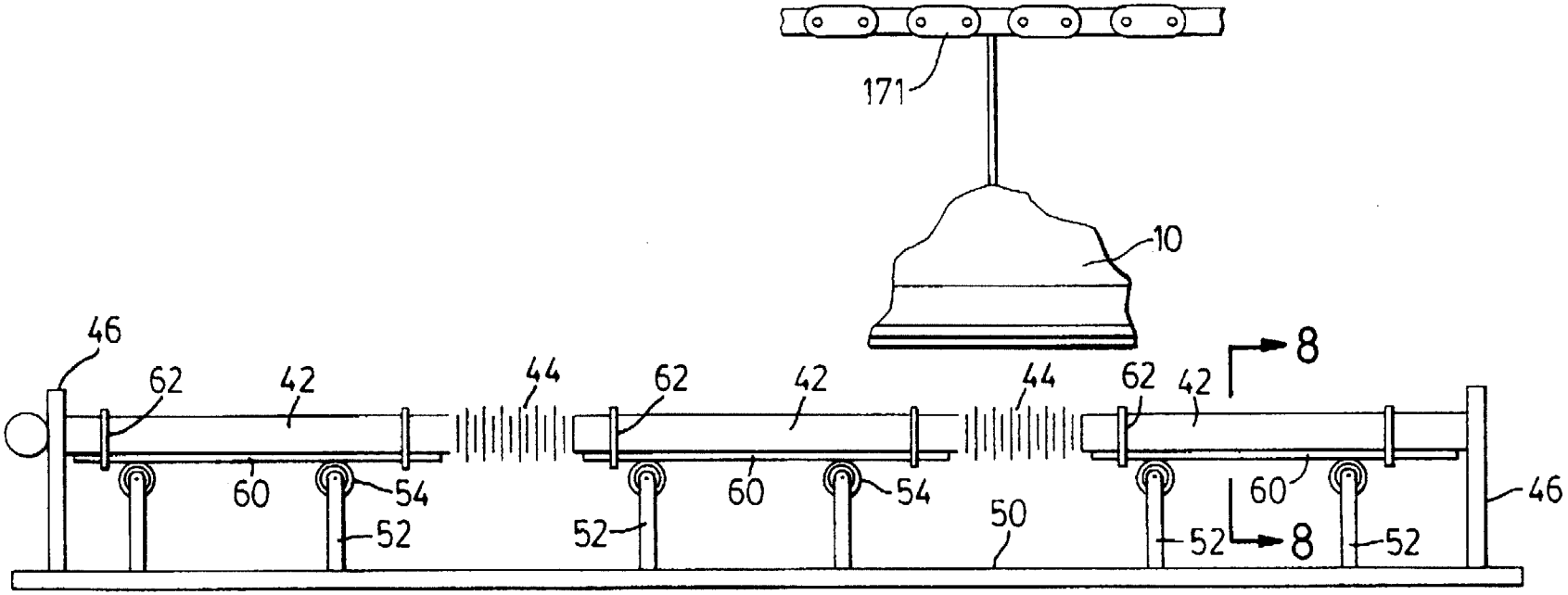
FIG. 3 is a schematic elevational view of a second embodiment of this invention.

In FIG. 3 the schematic illustration of an entire installation includes an elongate pipe 42 which is broken into pipe segments 42*a*, 42*b*, etc. at two intermediate locations by an expansion bellows or muffles 44. Supporting the elongate pipe 42 firmly at both ends are support elements 46, both of which are fixedly secured to a floor or other substrate 50.

FIG. 3 also shows a plurality of upright stanchions 52, illustrated with rotary wheels 54 to represent schematically a more complex wheeled carriage (described below).

The elongate pipe 42 is firmly secured to a track 60 by clamping means 62, which will be described in greater detail below, with reference to other figures.

Figure 4:
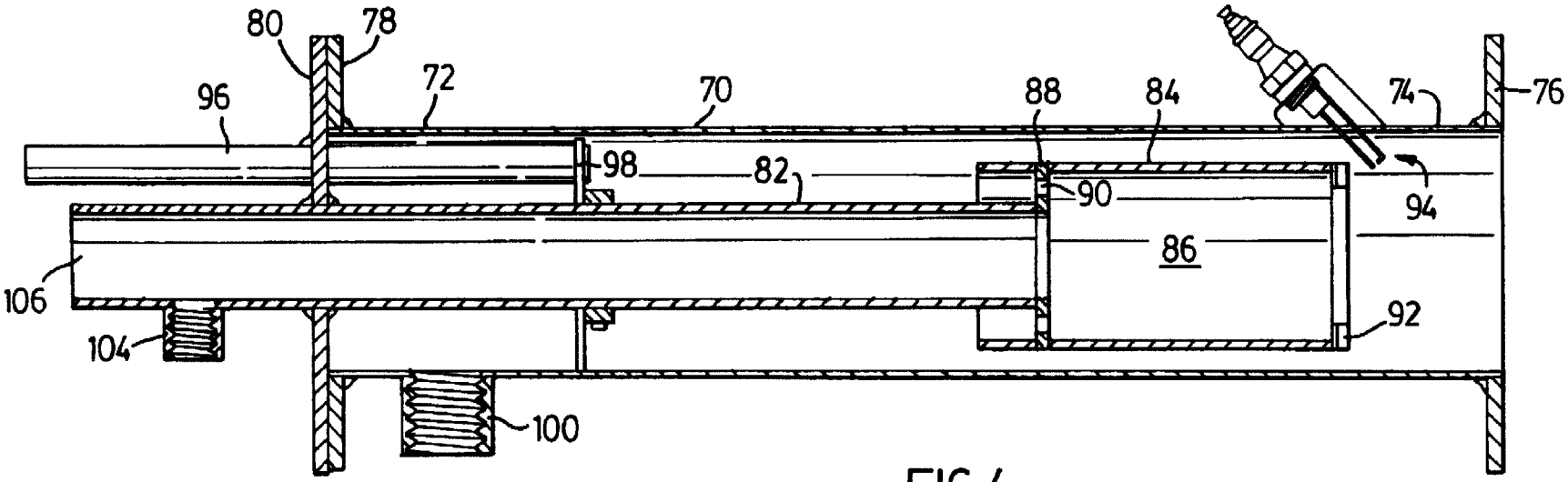
FIG. 4 is an axial sectional view of a burner unit for use with either embodiment of this invention.

Attention is now directed to FIG. 4, which shows an axial section through a suitable burner for use with either embodiment. In FIG. 4, an outer barrel 70 has a rearward end 72 and a forward end 74. An annular flange 76 is welded to the forward end of the barrel 70. A similar annular flange 78 is welded to the barrel at the rearward end 72.

The annular flange 78 at the rearward end 72 of the barrel 70 provides a clamping base against which a further annular flange 80 can be clamped. The annular flange 80 is welded or otherwise fixedly secured to a pipe 82 which is adapted to receive a gaseous fuel such as natural gas.

Secured to the forward (downstream) end of the pipe 82 is a sleeve 84 which internally defines a mixing chamber 86. The diameter of the sleeve 84 is larger than that of the pipe 82, and a further annular flange 88 is interposed between them, in order to support the sleeve from the pipe 82. It will be noted that the sleeve 84 extends rearwardly as well as forwardly from the flange 88, and it will be further noted that the flange 88 contains a plurality of openings 90.

At the forward (downstream) end of the sleeve 84, there is provided an inward lip 92 for the purpose of centering the flame and promoting good mixing.

At or just downstream of the lip 92 are provided electrodes 94 which can be made to spark and ignite the fuel mixture.

The rearward annular flange 80 is provided with a series of circumferentially distributed circular openings through which an equal plurality of short-length feed pipes 96 can pass. In FIG. 4, only one the pipes 96 has been illustrated, to avoid cluttering the drawing. The rightward end of the feed pipe 96 enters the space between the pipe 82 and the barrel 70, and is adapted to deliver secondary air into that space. In order to keep the feel pipe 96 aligned with the other components, a slidable annular flange 98 is provides, and is firmly secured (as by welding or other means) to the forward end of all feed pipe 96. With this construction, experimental work may be carried out in order to determine the depth of penetration of the feed pipes 96 into the secondary air space which will provide the cleanest or most complete combustion.

It will be clear that the secondary air entering through the feed pipe 96 passes into the combustion chamber 86 through the plurality of openings 90.

Additional secondary air can be forced or drawn through a separate air inlet 100 into the space between the pipe 82 and the barrel 70. By providing a loose fit for the annular flange 98, air entering through the inlet 100 can find its way to the openings 90.

Primary air enters the pipe 82 through an air inlet 104, while fuel is taken in through the main leftward opening 106 of the pipe 82.

Figure 5:
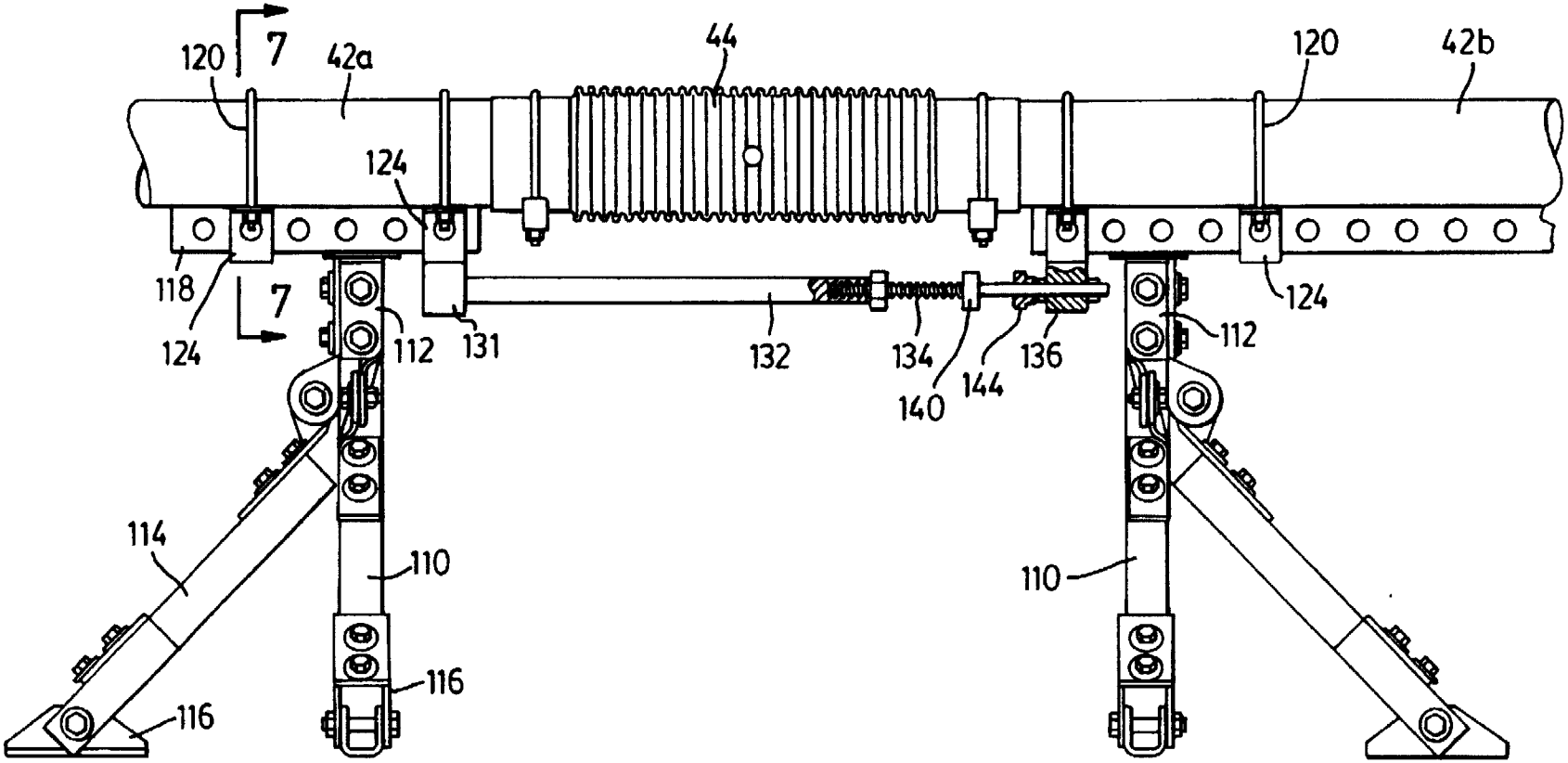
FIG. 5 is a more detailed elevational view of a portion of the system illustrated in FIG. 3.

Attention is now directed to FIG. 5, which shows a portion of the assembly in greater detail.

In FIG. 5 a pair of stanchions 110 are illustrated. Each stanchion 110 consist of an upright member 112 from which three angular braces 114 extend downwardly and outwardly to respective mounting feet 116. Suitable flanges and connecting portions are provided to secure the various components of each stanchion together.

At the top of each stanchion there is provided a roller assembly which is adapted to ride within an elongate track 118 to which the respective pipe segments **42*a*, 42*b*, etc. are secured. The securement of the pipe segments to the track 118 is accomplished by means of U-shaped hoop fasteners 120. The hoop fasteners 120 are externally threaded adjacent their two free ends 122, and these pass through suitable openings in a bracket 124 which has a central rectangular portion 126 situated between two outward flanges 128. A pair of nuts 130 are threaded on the ends 122, and can be tightened to secure the pipe 42*a*, 42*b*, etc. against the track 118**.

It will be appreciated that, in view of the fixed positioning of the supports 46 (shown in FIG. 3), the substantial increase in the temperature of the pipe segments **42*a*, 42*b*, etc. will cause those segments to expand and move longitudinally. The bellows or muffle 44** between each longitudinally adjacent pair of pipe segments is able to expand or contract longitudinally, while remaining in airtight connection with the two pipe segments that it joins.

There is a need to limit the degree to which each muffle is forced to contract by the longitudinal expansion of the pipe segments. This necessity is taken care of by means shown in FIGS. 5 and 6. Looking first at FIG. 5, a downward extension 131 secured to a bracket 124 immediately upstream of one of the muffles 44 supports the leftward end of a shunt ram 132, the shunt ram 132 carrying, at its rightward end, a longitudinally adjustable guide rod 134 which is threadedly received the shunt ram 132, and which slides through a rod slip guide housing 136. The rod 134 also supports an internally threaded shunt 140.

Assume first that the pipe segment **42*a* shown at the left in FIG. 5 is the further leftward segment (the one that is attached to the burner). As this pipe segment 42*a* rises in temperature, its rightward end will seek to move rightwardly with respect to the stanchion shown at the left in FIG. 5, causing the track 124 to move rightwardly with respect to the stanchion 112, this being permitted by a small wheeled carriage 138 (see FIG. 7) attached to the top of the stanchion 112 and received within the track 118. Meanwhile, the rightward pipe segment 42*b* is also heating up (although probably not to the same degree or as fast as the segment to the left), and this may or may not cause movement of the leftward end of the rightward segment 42*b*. Whether or not there is any longitudinal movement of the leftward end of the rightward pipe segment 42*b* in FIG. 5, the positioning of the shunt 140 will absolutely limit the degree of compression supported by the muffle 44. The shunt 140 comes into contact with a shunt stop 144, and any further rightward movement of the rightward end of the leftward pipe segment 42*a* then pushes the rightward pipe segment 42*b*** to the right.

Figure 6:
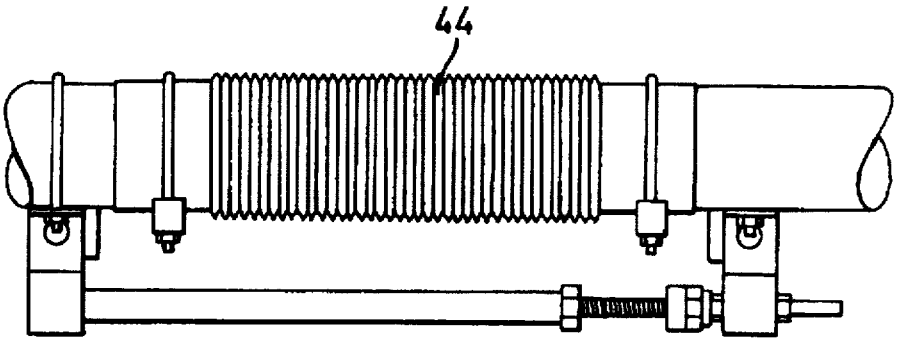
FIG. 6 is a partial view of the apparatus shown in FIG. 5, illustrating the compressed condition of one of the components.

Attention is directed to FIG. 6. in which the maximum compressed condition of the muffle 44 is shown. The remaining components of this portion of the apparatus have not been numbered in FIG. 6, in order to avoid cluttering the drawings.

Figure 8:
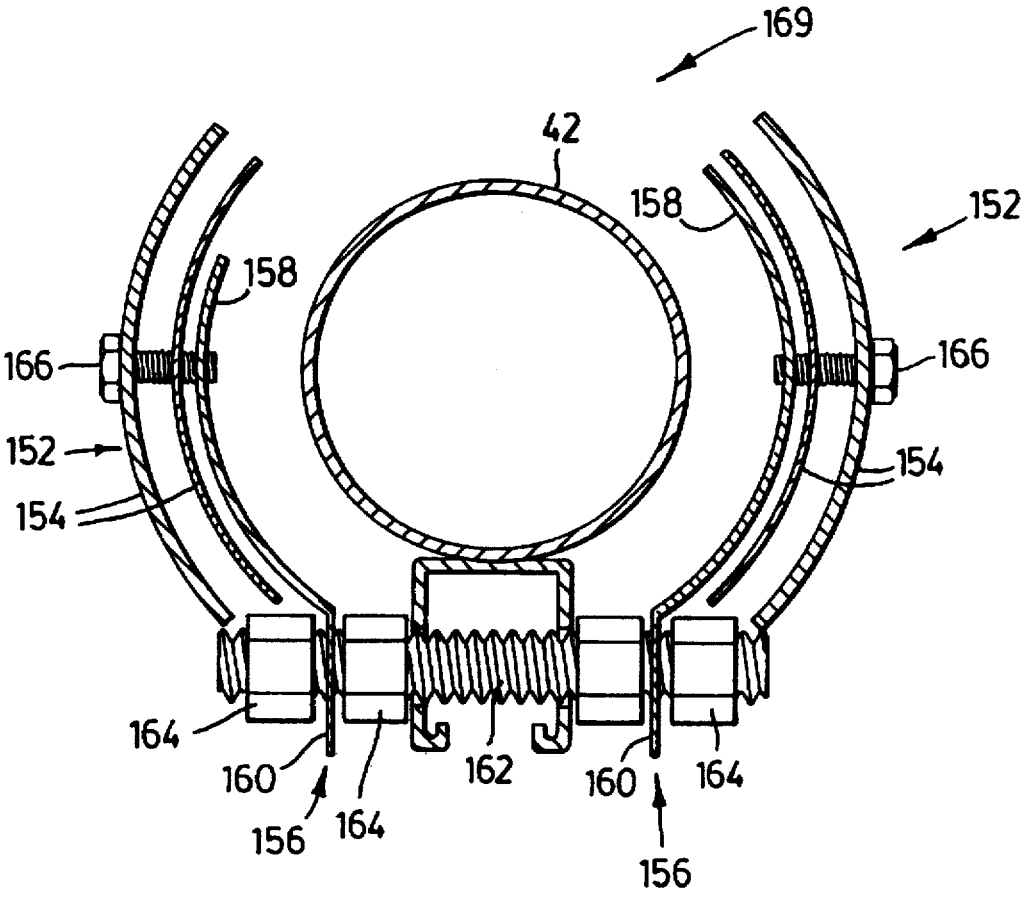
FIG. 8 is a cross-sectional view taken at the line 8—8 in FIG. 3, and showing side-mounted baffles in operative position.
Figure 7:
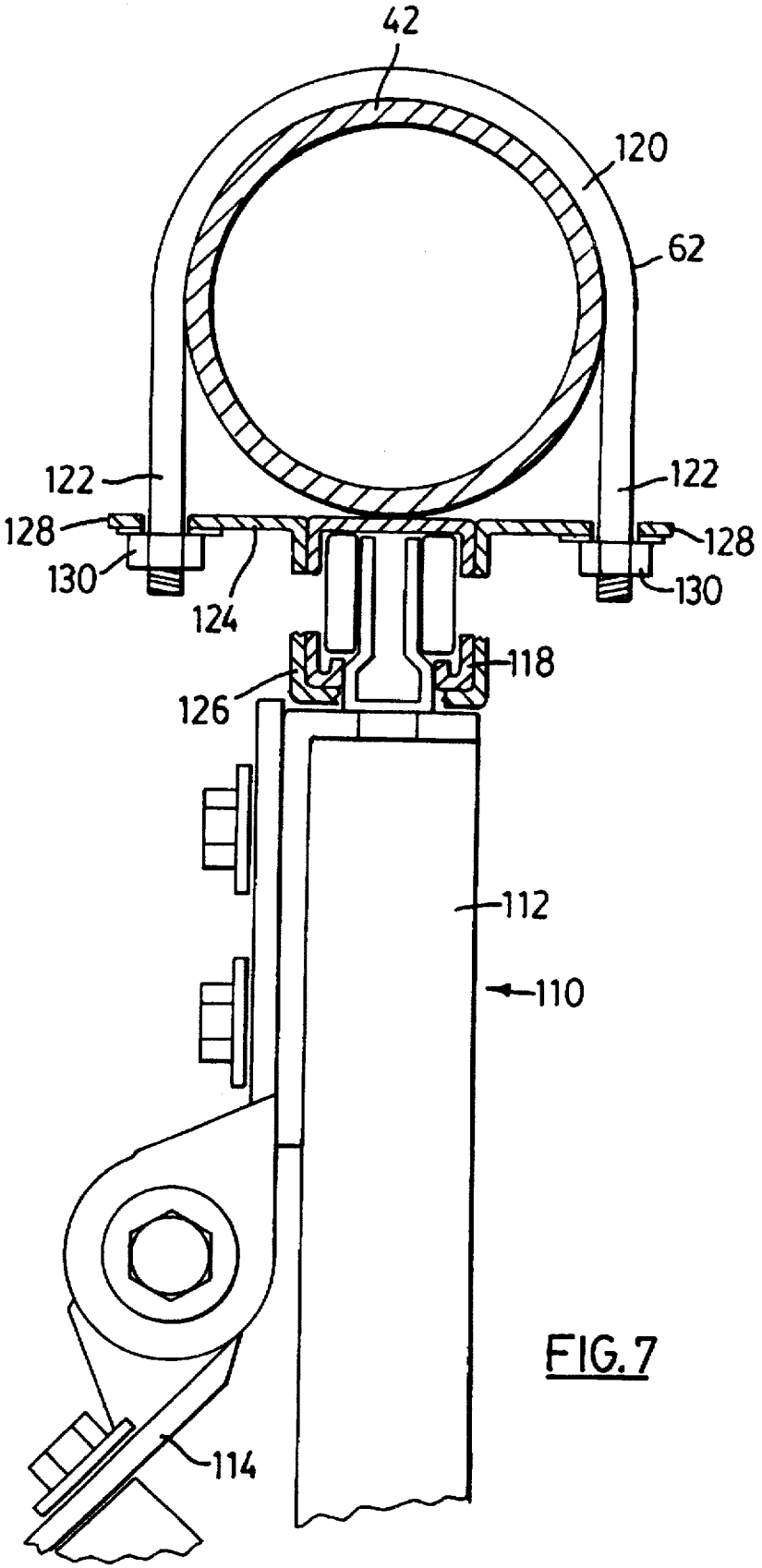
FIG. 7 is a cross-sectional view taken at the line 7—7 in FIG. 5, without side-supported baffles.

Part of this invention is the provision of part-cylindrical baffles affixed to either side of the pipe 42 over the major portion of the length thereof, and circumferentially adjustable in order to "aim" the infrared radiation being given off by the pipe 42, and also to "aim" air passing upwardly between the baffles and the pipe and receiving convection heat from the pipe. Attention is directed to FIG. 8, which shows two compound baffles at 152, each consisting of two part-cylindrical shells 154 having substantially the same circumferential extent. The shells 154 of each composite baffle are locked in substantially concentric but radially spaced positions, as illustrated in FIG. 8.

The support for the baffles 152 is also illustrated in FIG. 8, in which two support units 156 each include a part-cylindrical portion 158, these portions being spaced from the pipe 42.

In order to retain the portions 156 in position, each portion 156 has an integral flat flange 160 which is secured by a plurality of threaded fasteners 162 spaced longitudinally, these being provided with suitable nuts 164 both inside and outside the flanges 160.

Extending substantially radially outwardly from each of the part-cylindrical, portions 156 are fastening means 166, the latter being secured at the inward end to the respective part-cylindrical portion, and projecting outwardly therefrom.

Each of the part-cylindrical shells of the respective baffle 152 has a circumferential slot through which the fastening means, more specifically a threaded shaft which is part of the fastening means, can project. Suitable nuts or the like are threaded on the shafts just mentioned, so that the position of the composite baffles may be adjusted in order to alter the upper elongate opening 169 through which radiant heat is given off by the pipe 42. Adjustment of the baffles also allows the width of the opening 169 to be adjusted.

The method for curing heat-curable paint on external vehicle surfaces involves providing the apparatus described above together with transport means for moving the external vehicle surfaces substantially horizontally at a controllable speed, with the surfaces substantially aligned with the direction of their movement. Such transport means could include a chain transport (shown at 171 in FIG. 3) from which the vehicles or vehicle parts (such as the rocker panel 10 FIG. 1) are hung and moved longitudinally. The apparatus further includes the elongate pipe 42 described above, with the pipe being clamped in a position in which it is below but adjacent to the path along which the surfaces of the vehicle move. The two part-cylindrical baffles at opposite sides of the pipe, as described earlier, are then adjusted to define a desired position and size for the upper elongate opening between them, this opening being directed generally at the path along which the vehicle surfaces are moved. Means are also provided to burn fuel at one end of the pipe, and to send the products of combustion to the other end, thus heating up the entire length of the pipe.

Fuel and air are then delivered simultaneously to the burner, and ignited so that combustion takes place in the pipe. This will result in the outer surface of the pipe emitting radiant heat through the upper elongate opening 169, such that the radiant heat will fall upon the portion of the surface on which the paint is to be cured. At the same time, convective heat is transferred to air passing upwardly between the baffles and the pipe, and at least a portion of the air thus heated impinges against the surfaces of the vehicle which are moving along the path.

While two embodiments of this invention are illustrated in the accompanying drawings and described hereinabove, it will be evident to those skilled in the art that changes and modifications may be made therein without departing from the essence of this invention, as set forth in the following claims.

The embodiments of the invention in which an exclusive property or privilege is claimed are defined as follows:

1. In combination:

an elongate pipe defining an internal combustion chamber, clamping means for supporting the pipe in a substantially horizontal position, two part-cylindrical baffles, support means for support the baffles generally at opposite sides of the pipe so that they are generally concentric therewith, but are spaced from the pipe and from each other so as to define an upper elongate opening and lower aperture means, a fuel burner at one end of the pipe, feed means for delivering fuel and air simultaneously to the fuel burner, and an ignition device for igniting fuel within the burner, so that combustion takes place in said combustion chamber, whereby the outer surface of the pipe emits radiant heat primarily through said upper elongate opening, and convective heat is transferred to air passing upwardly between the baffles and the pipe.

2. The combination claimed in claim 1, in which each baffle comprises two part-cylindrical shells of substantially the same circumferential extent, the shells of each baffle being locked in substantially concentric but radially spaced apart positions.

3. The combination claimed in claim 2, in which the support means is adjustable, such that the circumferential position of each baffle can be changed, and the width of the elongate opening can be altered, said lower aperture means being constituted by a lower elongate opening between the baffles.

4. The combination claimed in claim 1, in which said support means for the baffles includes:

two support units, each comprising a part-cylindrical portion, the part-cylindrical portions being spaced from but adjacent to the pipe, retaining means to retain the part-cylindrical portions in spaced position about the pipe, fastening means secured to each said part-cylindrical portion and projecting outwardly therefrom, slots in said baffles to receive respective fastening means therethrough such that the baffles can slide circumferentially with respect to the fastening means, and tightening means cooperating with the fastening means to secure the baffles at a desired circumferential position with respect to the pipe.

5. The combination claimed in claim 4, in which the retaining means includes a flat flange extending integrally from each part-cylindrical portion, along with fasteners for holding the flanges firmly at a predetermined spacing, in which said fastening means includes threaded shafts projecting radially away from the respective part-cylindrical portions, and in which said tightening means includes threaded nuts.

6. The combination claimed in claim 5, in which each baffle comprises two part-cylindrical shells of substantially the same circumferential extent, the shells of each baffle being locked in substantially concentric but radially spaced positions.

7. Apparatus for curing heat-curable paint on vehicle rocker panels, comprising:

transport means for moving vehicle rocker panels substantially horizontally at a controllable speed, an elongate pipe defining an internal combustion chamber, the pipe being clamped in a position in which it is below but adjacent to the path along which the rocker panels are moved by said transport means, two part-cylindrical baffles, support means for supporting the baffles generally at opposite sides of the pipe so that they are generally concentric therewith, but are spaced from the pipe and from each other so as to define an upper elongate opening directed generally at the path along which the rocker panels are moved, and a lower elongate aperture means, a fuel burner at one end of the pipe, feed means for delivering fuel and air simultaneously to the fuel burner, and an ignition device for igniting fuel within the burner, so that combustion takes place in said combustion chamber, whereby the outer surface of the pipe emits radiant heat primarily through said upper elongate opening, the radiant heat intersecting said path, and whereby convective heat is transferred to air passing upwardly between the baffles and the pipe, at least a portion of the thus heated air impinging against rocker panels moving along said path.

8. The apparatus claimed in claim 7, in which each baffle comprises two part-cylindrical shells of substantially the same circumferential extent, the shells of each baffle being locked in substantially concentric but radially spaced apart positions.

9. The apparatus claimed in claim 8, in which the support means is adjustable, such that the circumferential position of each baffle can be changed, and the width of the elongate opening can be altered.

10. The apparatus claimed in claim 7, in which said support means for the baffles includes:

two support units, each comprising a part-cylindrical portion, the part-cylindrical portions being spaced from but adjacent the pipe, retaining means to retain the part-cylindrical portions in position, fastening means secured to each said part-cylindrical portion and projecting outwardly therefrom, slots in said baffles to receive respective fastening means therethrough such that the baffles can slide circumferentially with respect to the fastening means, said slots having a circumferential component, and tightening means cooperating with the fastening means to secure the baffles at a desired circumferential position with respect to the pipe.

11. The apparatus chimed in claim 10, in which the retaining means includes a flat flange extending integrally from each part-cylindrical portion, along with fasteners for holding the flanges firmly at a predetermined spacing, in which said fastening means includes threaded shafts projecting radially away from the respective part-cylindrical portions, and in which said tightening means includes threaded nuts.

12. The combination claimed in claim 11, in which each baffle comprises two part-cylindrical shells of substantially the same circumferential extent, the shells of each baffle being locked in substantially concentric but radially spaced positions.

13. A method for curing heat-curable paint on external vehicle surfaces, comprising:

A. providing an apparatus including:

a) transport means for moving the surfaces substantially horizontally at a controllable speed with the surfaces substantially aligned with the direction of their movement, b) an elongate pipe defining an internal combustion chamber, the pipe being clamped in a position in which it is below but adjacent to the path along which the surfaces move, c) two part-cylindrical baffles supported generally at opposite sides of the pipe so that they are generally concentric therewith, but are spaced from the pipe and from each other so as to define an upper elongate opening directed generally at the path along which the surfaces are moved, and a lower elongate aperture means, and d) a fuel burner at one end of the pipe, B. delivering fuel and air simultaneously to the fuel burner, and igniting fuel within the burner so that combustion takes place in said combustion chamber, resulting in:

e) the outer surface of the pipe emitting radiant heat primarily through said upper elongate opening, the radiant heat intersecting said path, and f) convective heat being transferred to air passing upwardly between the baffles and the pipe from said lower elongate aperture means to said upper elongate opening, at least a portion of the thus heated air impinging against surfaces moving along said path.

14. The method claimed in claim 13, in which, under the provision of apparatus set forth in part A, each baffle comprises two part-cylindrical shells of substantially the same circumferential extent, and the shells of each baffle are locked in substantially concentric but radially spaced apart position.

15. The method claimed in claim 14, in which step A is followed by a step A(1) in which the circumferential position of each baffle is adjusted to give the elongate opening a desired width.

16. The method claimed in claim 13, in which the baffles are supported from two support units, each comprising a part-cylindrical portion, the part-cylindrical portions being spaced from but adjacent to the pipe.

* * * * *